United States Patent [19]

Sanders

[11] Patent Number: 4,550,583

[45] Date of Patent: Nov. 5, 1985

[54] QUICK ADJUSTING ROLLING MILL

[75] Inventor: Eugene T. Sanders, LaGrange, Ga.

[73] Assignee: Southwire Company, Carrollton, Ga.

[21] Appl. No.: 376,359

[22] Filed: May 10, 1982

[51] Int. Cl.[4] ..... B21B 31/18

[52] U.S. Cl. ..... 72/247; 72/248

[58] Field of Search ..... 72/195, 199, 221, 247, 72/248; 29/124, 125

[56] References Cited

U.S. PATENT DOCUMENTS

| | | | |
|---|---|---|---|
| 24,453 | 6/1859 | Gage | 29/125 |
| 600,700 | 3/1898 | Weber | 72/247 |
| 1,926,830 | 9/1933 | Yates | 72/247 |
| 3,089,364 | 5/1963 | Lowinger | 72/248 |

*Primary Examiner*—Lowell A. Larson
*Assistant Examiner*—Jorji M. Griffin
*Attorney, Agent, or Firm*—Herbert M. Hanegan

[57] ABSTRACT

A quick adjusting square wire or rectangular wire rolling mill comprising segmented work rolls and a connection between at least one segments on each roll for adjusting positions of said segments, and method of adjusting the roll pass of a square wire or rectangular wire rolling mill without replacing work rolls.

13 Claims, 4 Drawing Figures

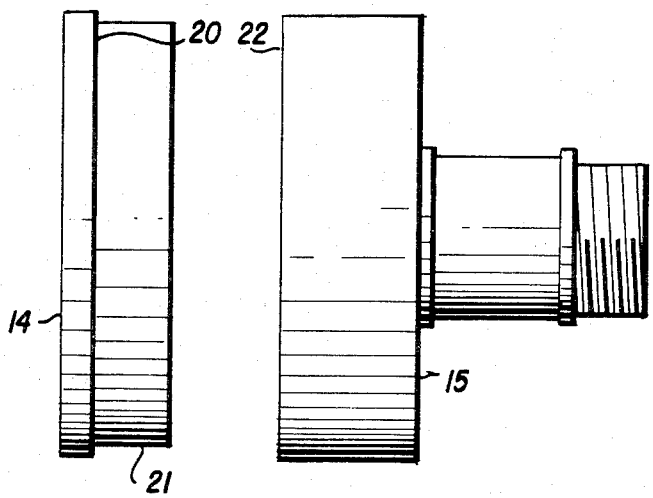
FIG. 2
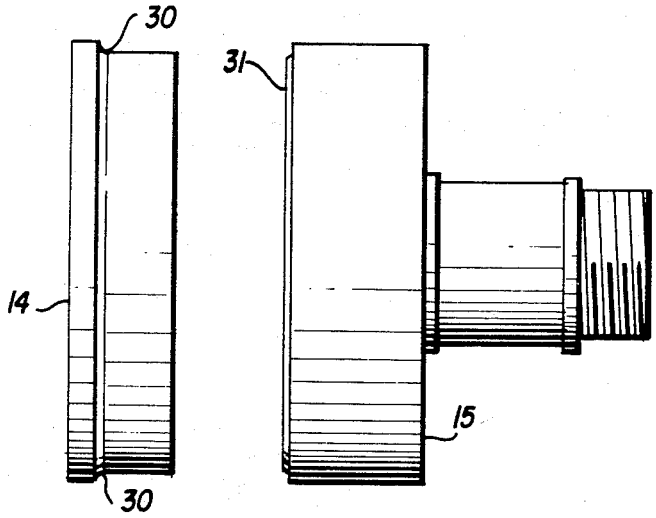
FIG. 3
FIG. 4
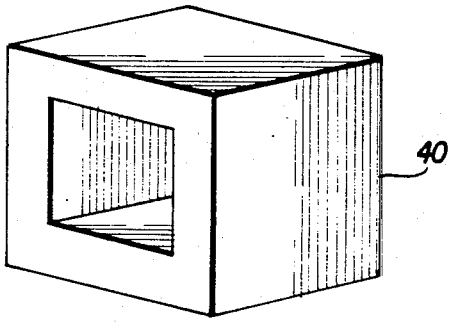

QUICK ADJUSTING ROLLING MILL

TECHNICAL FIELD

The present invention relates generally to a system for rolling square and rectangular wire, and specifically to a rolling mill wherein roll pass dimensions are quickly changed and adjusted.

BACKGROUND ART

Square wire and rectangular wire are normally used for windings such as those in motors and magnets. Roll forming of square and rectangular wire is well known. Examples of square and rectangular wire are shown in U.S. Pat. No. 3,417,593. While U.S. Pat. No. 3,417,593 claims a relatively light duty, hand held device for squaring small round wire, the general principle of rolling stock between perpendicular sets of parallel flat rolls is similar to the method of rolling square or rectangular wire in a rolling mill. Aside from the obvious differences required for more heavy duty rolling mills such as drive trains and strain resistant components, a major difference is that the work rolls normally have predetermined grooves which cooperate to substantially enclose the stock on all sides in order to prevent undesired deformation of the stock in directions parallel to the axis of the work rolls by affirmative control. An example of such work rolls is disclosed in U.S. Pat. No. 4,193,823. Rolls for forming square or rectangular wire must have rectangular grooves. Such rolls are shown at FIG. 2 of U.S. Pat. No. 3,848,447. The typical rolling stand of a rectangular wire rolling mill is of the straddle mount type shown in U.S. Pat. Nos. 3,848,447 and 3,691,809 which require extensive dismantling of the mill in order to change rolls when roll pass dimensions need to be changed.

DISCLOSURE OF INVENTION

The present invention is an adjustable roll rolling mill for rolling square or rectangular wire wherein each roll is segmented into two cooperating portions which are quickly adjustable along the longitudinal axis of the roll. The apparatus allows one rolling mill to shape different sizes and types of wire by providing for quick adjustment of the width of the roll.

Thus the major object of this invention is to provide a quick adjusting rolling mill for square and rectangular wire.

BRIEF DESCRIPTION OF THE DRAWINGS

While the specification concludes with claims particularly pointing out and distinctly claiming the subject matter which is regarded as the invention, it is believed that the invention, objects, features and advantages thereof will be better understood from the following description taken in connection with the accompanied drawings in which like parts are given like identification numerals and wherein:

FIG. 2 is an exploded elevation of the roll of the present invention;

FIG. 3 is an exploded elevation of an alternate roll of the present invention; and FIG. 4 is an elevation of a square finishing die.

BEST MODE FOR CARRYING OUT THE INVENTION

Figure 1:
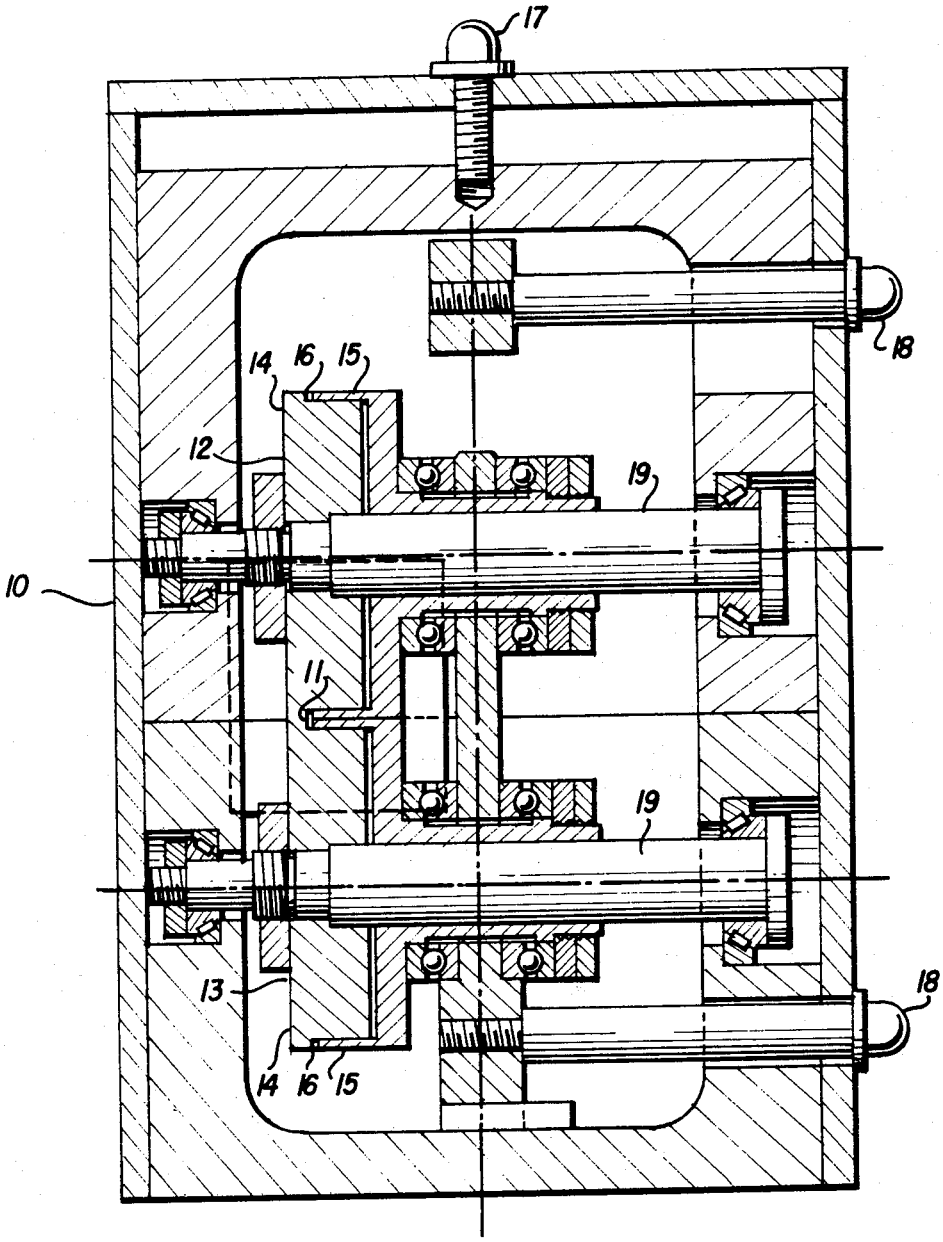
FIG. 1 is a cross-sectional view of the rolling mill of the present invention.

FIG. 1 illustrates a cross-section of the rolling mill of the present invention indicated generally at 10. Upper work roll 12 and lower work roll 13 cooperate to form a rectangular (or square) roll pass 11. Each work roll 12, 13 is segmented into a male segment 14 and a female segment 15 which are adjustably mounted on roll shafts 19 to define the groove 16 of each roll 12, 13. For purposes of this disclosure, the terms male and female are used as defined by Webster's New Collegiate Dictionary; male: designed for fitting into a corresponding hollow part; female: designed with a hollow into which a corresponding male part fits. Vertical adjustment means 17 are provided to move the rolls 12, 13 and the roll shafts 19 vertically toward and away from the roll pass 11. Lateral adjustment means 18 are provided to increase and decrease the distance between male segments 14 and female segments 15 in unison along the longitudinal axis of the roll shafts 19. Thus, the groove 16 and roll pass 11 dimensions are quickly adjustable to roll various sizes of square wire and rectangular wire without having to dismantle the rolling mill 10 to change rolls.

FIG. 2 illustrates the segmented roll 12 and 13 in more detail. The male segment 14 forms a first flange 20 perpendicular to the longitudinal axis of the work roll 12 or 13 and also forms the base 21 of the groove 16 concentric with the longitudinal axis of the work roll 12 or 13, while the female segment 15 forms a second flange 22 perpendicular to the longitudinal axis of the work roll 12 or 13.

FIG. 3 is provided to show that square wire and rectangular wire can be rolled having rounded corners by providing a first radius 30 at the juncture of the first flange 20 and the base 21 and a second radius 31 at the adjustable juncture of the second flange 22 and the base 21.

As the wire is rolled between the rolls 12 and 13, the compressive force causes metal of the wire to move into the adjustable juncture between the base 21 and the second flange 22, which leaves a mark or small fin on the rolled wire at or near two of the four corners of the wire. After rolling, the wire is passed through a conventional finishing die 40 of FIG. 4 which removes the marks. While adjustments to the wire dimensions require changes in finishing dies, die changes, in contrast to roll changes, are easily made.

While this invention has been described in detail with particular reference to a preferred embodiment thereof, it will be understood that variations and modifications can be made effective within the spirit and scope of this invention as described hereinbefore and as defined in the appended claims.

INDUSTRIAL APPLICABILITY

This invention is capable of exploitation in the square and rectangular wire industry and is particularly useful in a rolling mill for rolling various sizes of square or rectangular wire.

I claim:

1. A square wire and rectangular wire rolling mill of the type wherein wire is deformed by the grooves of cooperating work rolls comprising:

at least two segmented work rolls each having first and second concentrically aligned segments; and means coupled to one of said segments on each roll for simultaneously adjusting the position of said one segment relative to the other segment of each of said work rolls in equal increments.

2. The apparatus of claim 1 wherein said segmented work roll further comprises:

a male segment designed for fitting into a corresponding hollow part and adjustably mounted on a roll shaft;

a female segment designed with a hollow into which a corresponding male part fits and adjustably mounted on said roll shaft adjacent to said male segment.

3. The apparatus of claim 2 wherein said male segment further comprises a first flange perpendicular to the longitudinal axis of said work roll and a groove base concentric with the longitudinal axis of said work roll.

4. The apparatus of claim 2 wherein said female segment further comprises a second flange perpendicular to the longitudinal axis of said work roll.

5. The apparatus of claim 4 further comprising a radiused adjustable juncture of said second flange and a groove base of said male segment.

6. The apparatus of claim 3 further comprising a radiused juncture of said first flange and said groove base.

7. The apparatus of claim 2 further comprising means for moving said work rolls toward and away from each other.

8. The apparatus of claim 2 further comprising means for increasing and decreasing the distance between a first flange of said male segment and a second flange of said female segment.

9. The method of adjusting square wire or rectangular wire roll pass dimensions of a rolling mill of the type wherein wire is deformed by the grooves of cooperating work rolls comprising the steps of:

providing at least two segmented work rolls each having first and second concentrically aligned segments; and simultaneously adjusting the position of one of said segments relative to the other segment of each of said work rolls in equal increments.

10. The method of claim 9, further comprising the step of increasing or decreasing the distance between the work rolls.

11. A square wire and rectangular wire rolling mill of the type wherein wire is deformed by the grooves of cooperating work rolls, comprising:

segmented work rolls each having concentrically aligned first and second segments telescopically adjustable with respect to each other, said work rolls being rotatable about parallel axes; and means coupled to the first segment of each roll for simultaneously adjusting the position of the first segment relative to the other segment of each of said work rolls in equal increments.

12. The apparatus of claim 11, wherein the work rolls are in direct contact with each other.

13. The apparatus of claim 11, further comprising means for moving the axes of said work rolls toward and away from each other.

* * * * *